US009799504B2

(12) United States Patent
Nakazono et al.

(10) Patent No.: US 9,799,504 B2
(45) Date of Patent: Oct. 24, 2017

(54) ION SOURCE, QUADRUPOLE MASS SPECTROMETER AND RESIDUAL GAS ANALYZING METHOD

(71) Applicant: HORIBA STEC, CO., LTD., Kyoto (JP)

(72) Inventors: Masanobu Nakazono, Kyoto (JP); Hirotaka Yabushita, Kyoto (JP); Junya Nakai, Kyoto (JP); Tomoko Katsuda, Kyoto (JP)

(73) Assignee: HORIBA STEC, CO., LTD., Kyoto (JP)

( * ) Notice: Subject to any disclaimer, the term of this patent is extended or adjusted under 35 U.S.C. 154(b) by 0 days.

(21) Appl. No.: 15/370,365

(22) Filed: Dec. 6, 2016

(65) Prior Publication Data

US 2017/0170000 A1 Jun. 15, 2017

(30) Foreign Application Priority Data

Dec. 11, 2015 (JP) ..... 2015-242481

(51) Int. Cl.
*H01J 49/16* (2006.01)
*H01J 49/00* (2006.01)
*H01J 49/42* (2006.01)

(52) U.S. Cl.
CPC ..... *H01J 49/16* (2013.01); *H01J 49/0027* (2013.01); *H01J 49/42* (2013.01)

(58) Field of Classification Search
USPC ..... 250/282
See application file for complete search history.

(56) References Cited

U.S. PATENT DOCUMENTS 3,619,684 A * 11/1971 Andrew ..... H01J 49/14 250/427
3,998,718 A * 12/1976 Melliar-Smith ..... H01J 27/20 204/192.34
4,620,102 A * 10/1986 Watanabe ..... H01J 27/205 250/288

(Continued)

FOREIGN PATENT DOCUMENTS

JP 60-020442 A 2/1985
JP 60-084757 A 5/1985

(Continued)

OTHER PUBLICATIONS

European Extended Search Report issued in European patent application No. 16002628.2-1803 dated Apr. 20, 2017.

*Primary Examiner* — Phillip A Johnston
(74) *Attorney, Agent, or Firm* — Greenblum & Bernstein, P.L.C.

(57) ABSTRACT

In order to attain a main objective of the present invention to provide an ion source capable of efficiently extracting ions, the ion source is configured to include: a conductive tubular body having an ion emitting aperture in a tip surface thereof and a penetration portion in a side wall thereof allowing thermo-electrons to pass through from an outside toward an inside; a mesh surrounding an outer periphery of the penetration portion; and a thermionic emission filament surrounding an outer periphery of the mesh, such that the thermo-electrons emitted from the thermionic emission filament pass through the mesh and reach the inside of the conductive tubular body through the penetration portion.

7 Claims, 8 Drawing Sheets

(56) References Cited

U.S. PATENT DOCUMENTS

| | | | | |
|---|---|---|---|---|
| 6,949,735 | B1 * | 9/2005 | Hatakeyama | H01J 27/16<br>250/251 |
| 7,332,714 | B2 * | 2/2008 | Watanabe | H01J 41/10<br>250/281 |

FOREIGN PATENT DOCUMENTS

| | | | |
|---|---|---|---|
| JP | 60-084758 | A | 5/1985 |
| JP | 2012-003976 | | 1/2012 |
| WO | 2014/128462 | A | 8/2014 |

* cited by examiner

FI.3 (b)

ION SOURCE, QUADRUPOLE MASS SPECTROMETER AND RESIDUAL GAS ANALYZING METHOD

TECHNICAL FIELD

The present invention relates to an ion source used in, for example, a mass spectrometer.

BACKGROUND ART

For example, as an ion source used in a mass spectrometer, there has been known one that sample molecules are ionized by impacting electrons. In such an ion source, it is necessary that, by controlling thermo-electrons by causing a potential difference between a thermionic emission filament and a mesh for accelerating the electrons, the thermo-electrons appropriately accelerated are supplied to an ionization chamber.

This is because, for example, in the case of using argon as a sample, since it becomes difficult to analyze the argon sample if divalent ions are generated by strong impingement with thermo-electrons, it is suitable to impinge the thermo-electrons against the argon sample with a relatively small acceleration and, in this way, a suitable condition should be considered depending on a sample.

Further, since it is necessary to extract ions generated by the ion source from the ion source as an ion beam suitable for separation and analysis, it is also necessary to adjust a potential gradient in the ionization chamber to be optimized.

However, in a conventional ion source, as disclosed in Patent Literature 1, since an entire side wall of the ionization chamber is formed of a mesh, it is liable that an external electric field caused by a potential of a thermionic emission filament pass through the mesh and permeate into the ionization chamber, which may influence the electric field in the ionization chamber.

Therefore, in the case where the potential of the thermionic emission filament is changed in order to realize an optimal thermo-electron supply, the external electric field is changed and the changed electric field may possibly permeate into the ionization chamber to thereby also change the electric field in the ionization chamber. If the electric field in the ionization chamber is changed, it is necessary to adjust also a potential of an ion extraction electrode and adjust the potential gradient in the ionization chamber so as to easily extract the ions. If not so, there may arise a problem that the ions cannot be efficiently extracted from the ionization chamber.

Furthermore, in the case where the potential of the ion extraction electrode is changed to obtain an ideal potential gradient in the ionization chamber, unless the potential of the thermionic emission filament is adjusted to adjust also the permeation of the external electric field into the ionization chamber, it is liable that the ions cannot be efficiently extracted. In addition, by changing the potential of the thermionic emission filament, it is also liable that suitable thermo-electrons cannot be supplied to the ionization chamber.

That is, since the potential of the thermionic emission filament and the potential of the ion extraction electrode are in a subordinate relationship to each other, there has been a problem that it is difficult to simultaneously make both an ideal thermo-electron supply and a potential gradient in the ionization chamber compatible.

CITATION LIST

Patent Literature

Patent Literature 1: JP2012-003976A

SUMMARY OF INVENTION

Technical Problem

Therefore, the present invention has been made in order to solve the above problems, and an essential object thereof is to provide an ion source capable of efficiently extracting ions by simultaneously making both ideal thermo-electron supply and a potential gradient in an ionization chamber compatible.

Solution to Problem

In one aspect of the present invention, an ion source includes: a conductive tubular body having an ion emitting aperture in a tip surface thereof and a penetration portion in a side wall allowing thermo-electrons to pass through from an outside toward an inside; a mesh surrounding an outer periphery of the penetration portion; and a thermionic emission filament surrounding an outer periphery of the mesh, wherein the ion source is configured such that the thermo-electrons emitted from the thermionic emission filament pass through the mesh and reach the inside of the conductive tubular body through the penetration portion.

Here, the mesh refers to a member having one or a plurality of gaps opened for allowing the thermo-electrons to pass through, and in particular refers to a member having a pattern of the one or more gaps being arranged in a vertical lattice one, lateral lattice one, oblique lattice one, lattice crossing and wired mesh one, a pattern formed of one or more circular holes or polygonal holes, honeycomb structure pattern or the like.

According to such an ion source, since a partial portion of a side wall of the ionization chamber is formed of a conductive tubular body, it is possible to suppress an external electric field from penetrating into the ionization chamber. Therefore, even though the potential of the thermionic emission filament is changed, the change of the electric field in the ionization chamber can be reduced. Thus, it becomes possible to independently set a potential of the thermionic emission filament and a potential of the ion extraction electrode which were conventionally in a subordinate relationship. Since these potentials can be independently set, both an ideal thermo-electron supply and a potential gradient in the ionization chamber can be simultaneously made compatible although it was conventionally difficult. As a result, the ions can be efficiently extracted from the ion source.

In the case where the mesh is provided separately from the conductive tubular body so as to cover an entire or a part of the outside of the penetration portion, the degree of freedom in designing the ion source is improved and the thermo-electron supply to the ionization chamber and the potential gradient in the ionization chamber can be further optimized.

Specifically, it becomes possible to independently set the potentials of the thermionic emission filament, the mesh and the conductive tubular body, respectively. Therefore, the thermo-electrons emitted from the thermionic emission filament can be controlled not only by the potential of the mesh but also by the potential of the conductive tubular body, and thus the thermo-electrons can be more easily controlled compared to the conventional one.

Moreover, by arranging the mesh in the appropriate position between the penetration portion and the thermionic emission filament, the electric field caused by the potential of the thermionic emission filament can be effectively suppressed from penetrating into the ionization chamber. Thus, it becomes easier to form an ideal potential gradient in the ionization chamber.

In the case where the ratio between the thickness (l) of the conductive tubular body and the width (d) of the penetration portion is set to be $0.5<l/d<2$, both more optimal thermo-electron supply to the ionization chamber and the potential gradient in the ionization chamber can be made compatible.

In the case where the conductive tubular body includes two tubular body elements which are separated in an axial direction with their central axes aligned and a circumferential slit is formed between these two tubular body elements, the potentials of the two tubular body elements can be independently set, respectively. Therefore, the degree of freedom in designing the ion source can be further improved.

By the way, it is considered that, in the ionization chamber of the present invention having a partial portion of the side wall of the ionization chamber, since the electric field caused by a potential difference between the ion extraction electrode and the conductive tubular body is suppressed from permeating, it becomes difficult to cause a gradient of an electric field in the back of the ionization chamber separated from the ion extraction electrode. Therefore, there is a possibility that the ions cannot be efficiently extracted from the back of the ionization chamber where a potential gradient is less likely to be caused.

In the case where the ions cannot be efficiently extracted and remain in the ionization chamber, the electric field in the ionization chamber is disturbed by the influence of the remaining ions, and it is liable that the ions are further less likely to be extracted.

Therefore, in the case where a potential difference is provided between the two tubular body elements, a potential gradient is also caused between the two tubular body elements and it becomes possible to cause a potential gradient to the back of the ionization chamber. Thus, the ions in the ionization chamber can be further efficiently extracted.

As a specific embodiment of the ion source according to the present invention, a quadrupole mass spectrometer can be exemplified as a mass spectrometer including the ion source.

In the case where an analyzing method using the quadrupole mass spectrometer is a residual gas analyzing method including analyzing residual gas in a vacuum chamber, since the ions can be efficiently extracted from the ion source, it is possible to detect the residual gas of a thin concentration in the chamber.

Advantageous Effects of Invention

According to the ion source according to the present invention, since a partial portion of the side wall of the ionization, chamber is formed of a conductive tubular body, the external electric field is suppressed from permeating into the ionization chamber. Therefore, even though the potential of the thermionic emission filament is changed, the change of the electric field in the ionization chamber can be reduced. Thus, it becomes possible to independently set a potential of the thermionic emission filament and a potential of the ion extraction electrode which were conventionally in a subordinate relationship. Since these potentials can be independently set, both an ideal thermo-electron supply and a potential gradient in the ionization chamber can be simultaneously made compatible although it was conventionally difficult. As a result, the ions can be efficiently extracted from the ion source.

DESCRIPTION OF EMBODIMENTS

The following describes one embodiment of the present invention with reference to the accompanying drawings.

An ion source 21 according to the present embodiment is used in a residual gas analyzer RGA which is, for example, attached to a vacuum chamber VC such as a semiconductor process chamber VC to analyze residual gas in the chamber VC.

Here, the residual gas analyzer RGA is a quadrupole mass spectrometer which includes: a casing 1; a sensor part 2 and a data processing circuit 3 which are accommodated inside the casing 1.

Figure 1:
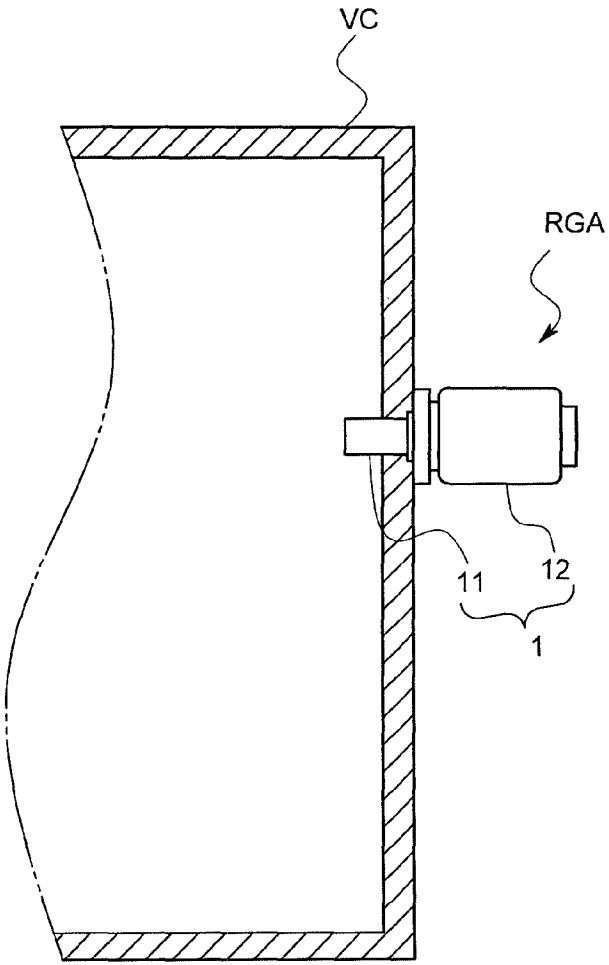
FIG. 1 is a schematic view showing a state of a residual gas analyzer according to one embodiment of the present invention attached to a vacuum chamber.

As shown in FIG. 1, the casing 1 includes: a first cover 11 attached to the chamber VC such that a distal end surface thereof is located inside the chamber VC and accommodating the sensor part 2; and a second cover 12 attached to the chamber VC and accommodating the data processing circuit 3.

In the distal end surface of the first cover 11 located inside the chamber VC, there is provided a gas inlet port 111 for introducing the gas in the chamber VC into the sensor part 2.

Figure 2:
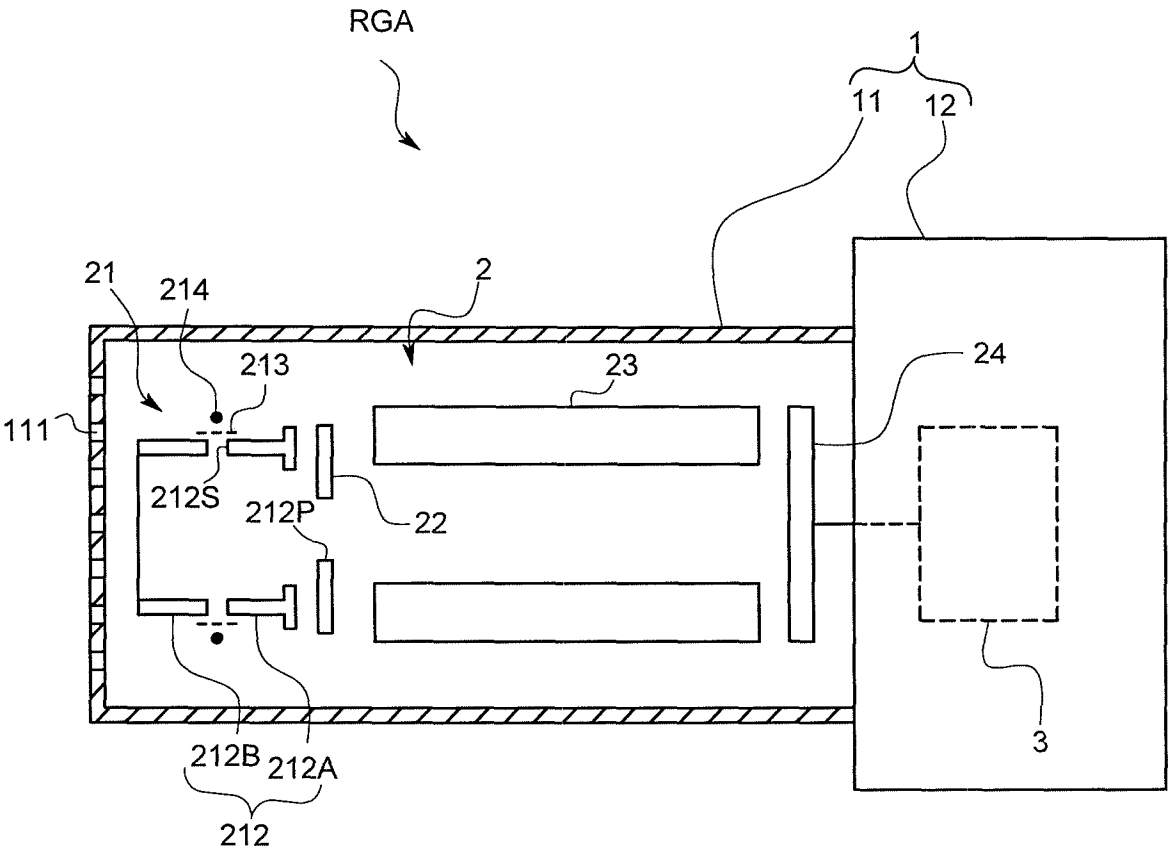
FIG. 2 is a schematic view showing an internal structure of the residual gas analyzer according to the same embodiment.

As shown in FIG. 2, the sensor part 2 includes: an ionization part 21; an ion extraction electrode 22; a quadrupole part 23; and a detection part 24. The ionization part 21 ionizes the sample gas introduced through the gas inlet port 111 by electron collision. The ion extraction electrode 22 extracts the ions generated by the ion source 21 and accelerates and converges the extracted ions. The quadrupole part 23 separates the ions accelerated and converged by the ion extraction electrode 22 according to a charge-to-mass ratio by a high frequency electric field generated by four cylindrical electrodes. The detection part 24 catches the ions separated by the quadrupole part 23 and detects as a current value and outputs the current value to the data processing circuit 3.

Figure 4:
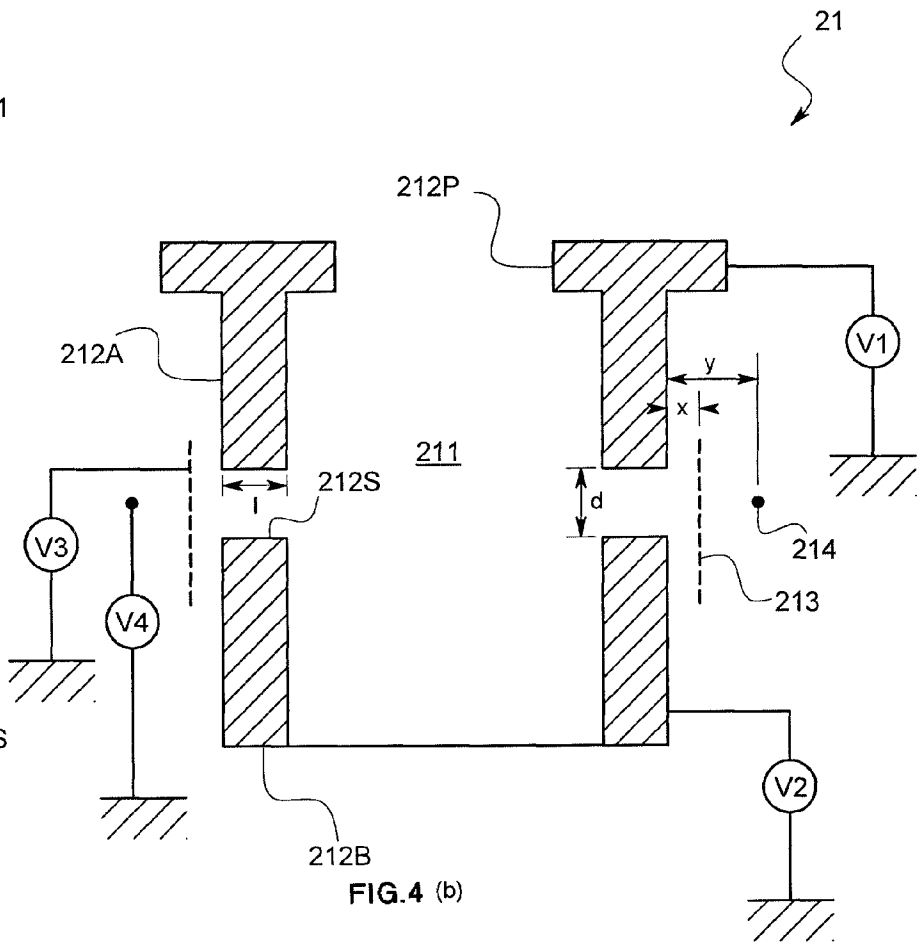
FIG. 4(*a*) is a structure view and FIG. 4(*b*) is a cross-sectional view of an ion source of the present embodiment.
Figure 4:
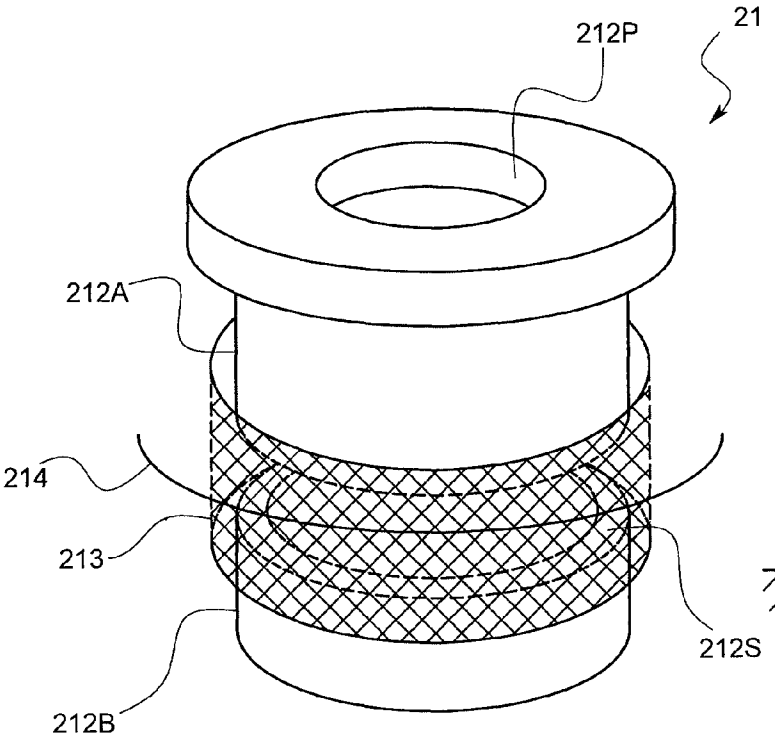

As shown in FIG. 4, the ion source 21 includes: a conductive tubular body 212 (referred to as "conductive cylindrical body 212" hereinafter in the present embodiment) which forms an ionization chamber 211 therein; a mesh 213 disposed around an outside of the conductive cylindrical body 212; and a thermionic emission filament 214 disposed around an outside of the mesh 213. These components are arranged such that the thermo-electrons emitted from the thermionic emission filament 214 pass through the mesh 213 for collecting and accelerating the thermo-electrons and reach the ionization chamber 211.

The conductive cylindrical body 212 is made of, for example, stainless steel such as SUS316. As shown in FIG. 4(*a*), the conductive cylindrical body 212 is formed of an imperforate wall of approximately 3 mm thick, and in the side wall thereof, there is formed a penetration portion on a virtual plane perpendicular to an axial direction in a form of a circumferential slit 212S having approximately 3 mm depth. The conductive tubular body 212 includes a first tubular body element 212A (referred to as "first cylindrical body element 212A" hereinafter in the present embodiment) and a second tubular body element 212B (referred to as "second cylindrical body element 212B" hereinafter in the present embodiment) which are separated from each other by the circumferential slit 212S. The first cylindrical body element 212A includes a circular ion emitting aperture 212P in its distal end surface, and the first cylindrical body element 212A together with the second cylindrical body element 212B forms the ionization chamber 211 as shown in FIG. 4(*b*).

In this configuration, the relationship between the thickness "l" of the conductive cylindrical body 212 and the width "d" of the circumferential slit 212S is defined to be $0.5<l/d<2$.

The mesh 213 is belt-shaped one covering the outside of the circumferential slit 212S and it is provided along the side surface shape and separated from the side surface of the conductive cylindrical body 212.

The mesh 213 allows the electrons emitted from the thermionic emission filament 214 to pass through gaps of the mesh 213 and enter the ionization chamber 211, and it is also configured to prevent an external electric field from entering the ionization chamber 211 to some degree.

The mesh 213 is made of a conductive member having the gaps for allowing the thermo-electrons emitted from the thermionic emission filament 214 to pass through, and each of the gaps has a shape of, for example, a vertical lattice pattern, which is also referred to as "grid" in some cases.

The opening ratio of forming the gap portions of the mesh 213 for allowing the thermo-electrons to pass through is approximately 50 to 90%, preferably 60 to 80%.

The thermionic emission filament 214 is made of, for example, yttria coated iridium formed in a semicircular shape, which is disposed around the outside of the mesh 213.

A radial distance (x) between an outer surface of the opening of the circumferential slit 212S and an inner surface of the mesh 213 and a radial distance (y) between the outer surface of the opening of the circumferential slit 212S and the thermionic emission filament 214 are set such that the suppression of the external electric field from permeating into the ionization chamber 211 and a suitable supply of the thermo-electrons are optimally balanced.

Further, as shown in FIG. 4(*b*), it is configured that, the first cylindrical body element 212A, the second cylindrical body element 212B, the mesh 213 and the thermionic emission filament 214 are respectively connected with power supply devices V1, V2, V3 and V4 which are built-in the second cover 12 such that the potentials thereof can be set, independently.

The data processing circuit 3 includes: such as an amplifier; A/D converter; D/A converter; CPU; memory; communication port, and it is configured to perform mass spectrometry based on a current value outputted from the sensor part 2. Further, if necessary, the analysis results thereof are transmitted to such as a general purpose computer a The data processing circuit 3 has also functions as the power supply devices V1, V2, V3 and V4 and functions as a power supply control part for controlling the power supply devices.

The data processing circuit 3 may be a single device or a plurality of devices connected to each other by wire or wireless, or it may be configured to use a general purpose computer as a part thereof.

Figure 5:
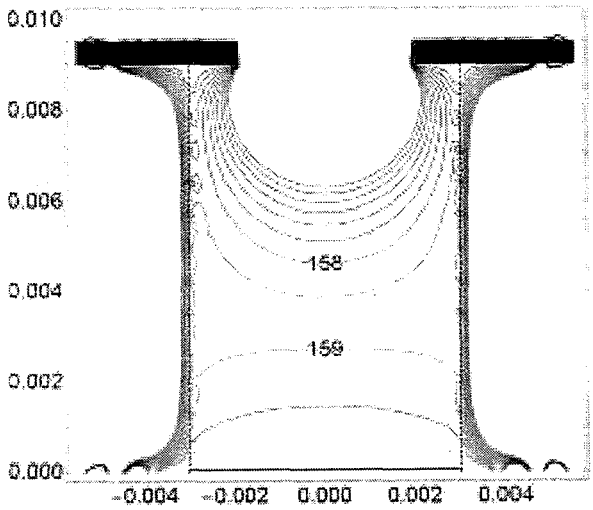
FIGS. 5(*a*), 5(*b*) and 5(*c*) are potential distribution diagrams inside an ionization chamber in a conventional example.
Figure 5:
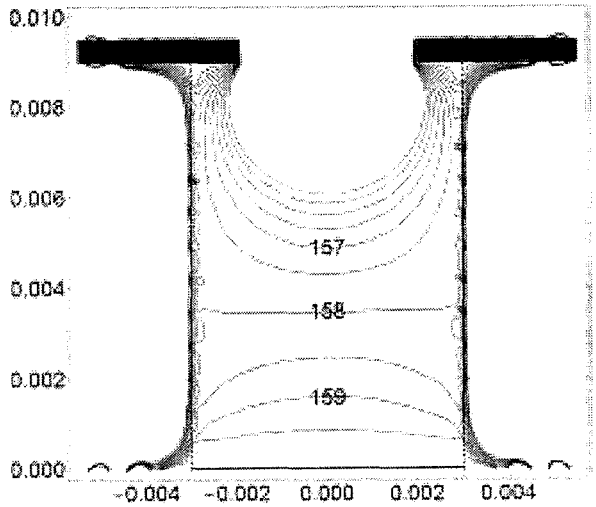
Figure 5:
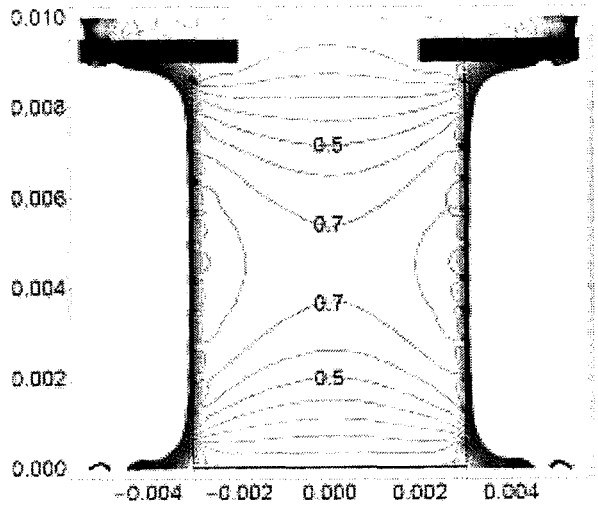
Figure 6:
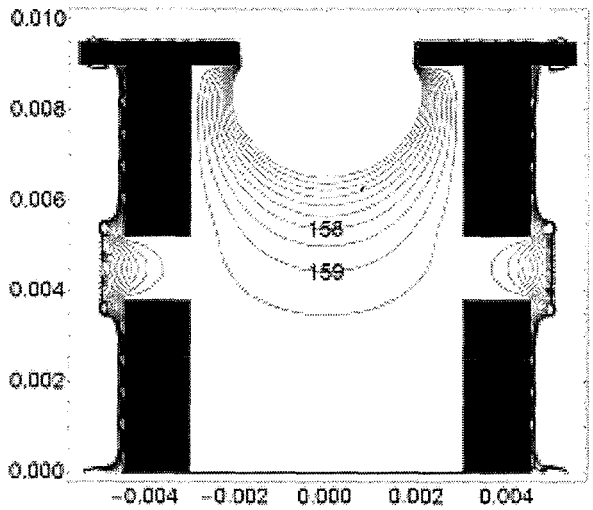
FIGS. 6(*a*), 6(*b*) and 6(*c*) are potential distribution diagrams inside an ionization chamber in the present embodiment.
Figure 6:
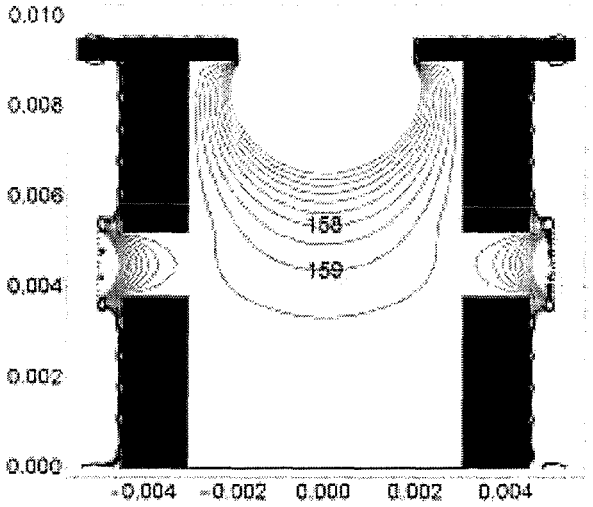
Figure 6:
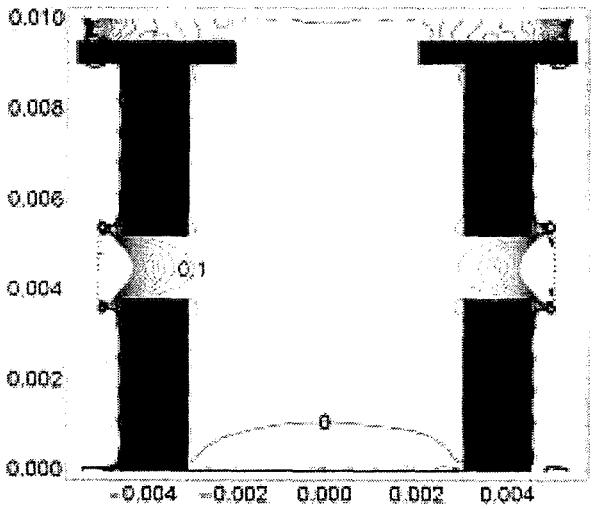

Next, regarding the potential distributions, the ion source 21 according to the present embodiment configured as described above is compared to a conventional ion source 21 having an entire side wall of an ionization chamber 211 formed with a mesh 213 with reference to FIGS. 5 and 6.

Figure 3:
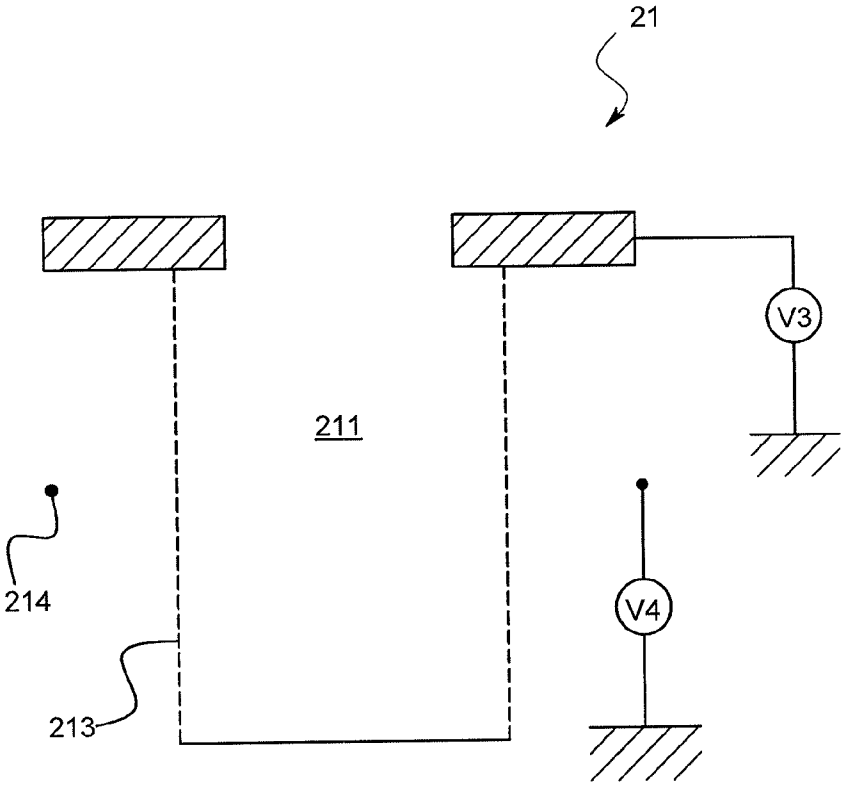
FIG. 3(*a*) is a structure view and FIG. 3(*b*) is a cross-sectional view of an example of a conventional ion source.
Figure 3:
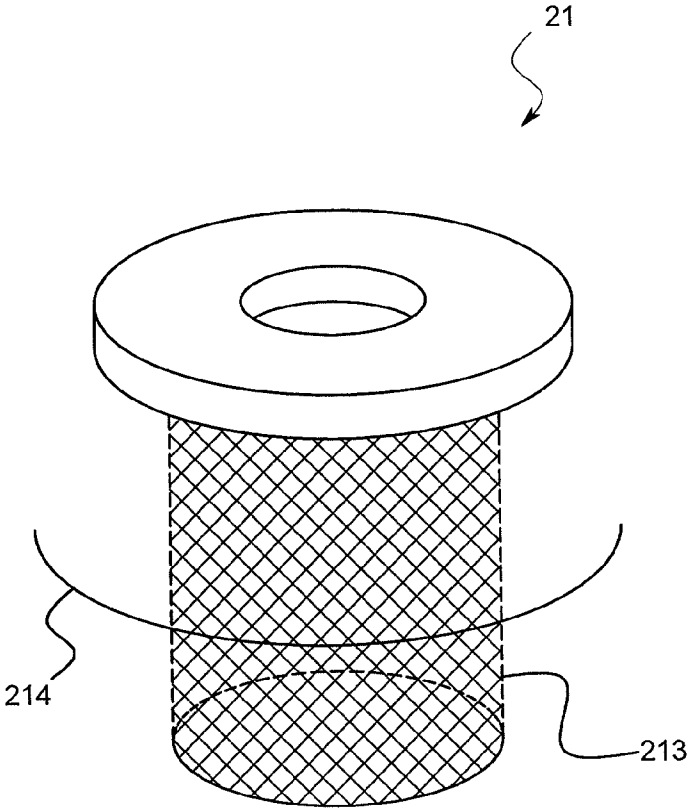

As the conventional ion source 21, for example, as shown in FIG. 3, it is considered to include the cylindrical mesh 213 which forms the ionization chamber 211 and a semi-arc-shaped thermionic emission filament 214 disposed around the outside of the mesh 213 for emitting thermo-electrons.

FIG. 5 shows a potential distribution inside the ionization chamber 211 of this conventional ion source 21, and FIG. 6 shows a potential distribution inside the ionization chamber 211 of the ion source 21 according to the present embodiment.

FIGS. 5(*a*) and 6(*a*) respectively show the potential distributions inside the ionization chamber 211 when movement energy of the thermo-electrons is 40 eV while the potential of the thermionic emission filament 214 is changed to 120V under the condition that the potential of the mesh 213 is 160V. Similarly, FIGS. 5(*b*) and 6(*b*) respectively show the potential distributions inside the ionization chamber 211 when movement energy of the thermo-electrons is 70 eV while the potential of the thermionic emission filament 214 is changed to 90V under the condition that the potential of the mesh 213 is 160V. FIG. 5(*c*) shows the difference between the potential distributions shown in FIGS. 5(*a*) and 5(*b*). Similarly, FIG. 6(*c*) shows the difference between the potential distributions shown in FIGS. 6(*a*) and 6(*b*). The vertical axis in each of FIGS. 5 and 6 indicates a distance (m) from the bottom of the ionization chamber 211, and the horizontal axis thereof indicates a distance (m) from the center axis of the ionization chamber 211. In addition, each of numerical values depicted on the contours of the electric field in the ionization chamber 211 represents a potential in a unit of V.

In the conventional ion source 21, as shown in FIG. 5(*c*) indicating the difference of the potential distributions between the case of FIG. 5(*a*) where the movement energy of the thermo-electrons is 40 eV while changing the potential of the thermionic emission filament 214 and the case of FIG. 5(*b*) where the movement energy is 70 eV under the same condition, since the electric field is changed in many positions in the ionization chamber 211, it can be understood that the electric field caused by the potential of the thermionic emission filament 214 passes through the mesh 213 and permeates into the ionization chamber 211. In the case where the electric field in the ionization chamber 211 is changed by changing the potential of the thermionic emission filament 214 in this way, the ions are liable not to be extracted from the ionization chamber 211 if a potential gradient in the ionization chamber 211 is not adjusted to be a condition of easily extracting the ions by adjusting also the potentials of the ion extracting electrodes 22.

On the other hand, in the ion source 21 according to the present embodiment as shown in FIG. 6(*c*) indicating the difference of the potential distributions between the case of FIG. 6(*a*) where the movement energy of the thermo-electrons is 40 eV and the case of FIG. 6(*b*) where the movement energy is 70 eV, since the change in potential distribution in the ionization chamber 211 is few, it can be understood that the influence of the electric field caused by the potential of the thermionic emission filament 214 on the electric field in the ionization chamber 211 is reduced. Therefore, it becomes possible to independently set the potential of the thermionic emission filament 214 and the potentials of the ion extracting electrodes 22. Thus, both an ideal thermo-electron supply and the potential gradient in the ionization chamber 211 can be made compatible simultaneously. As a result, the ions can be efficiently extracted from the ion source 21.

Figure 7:
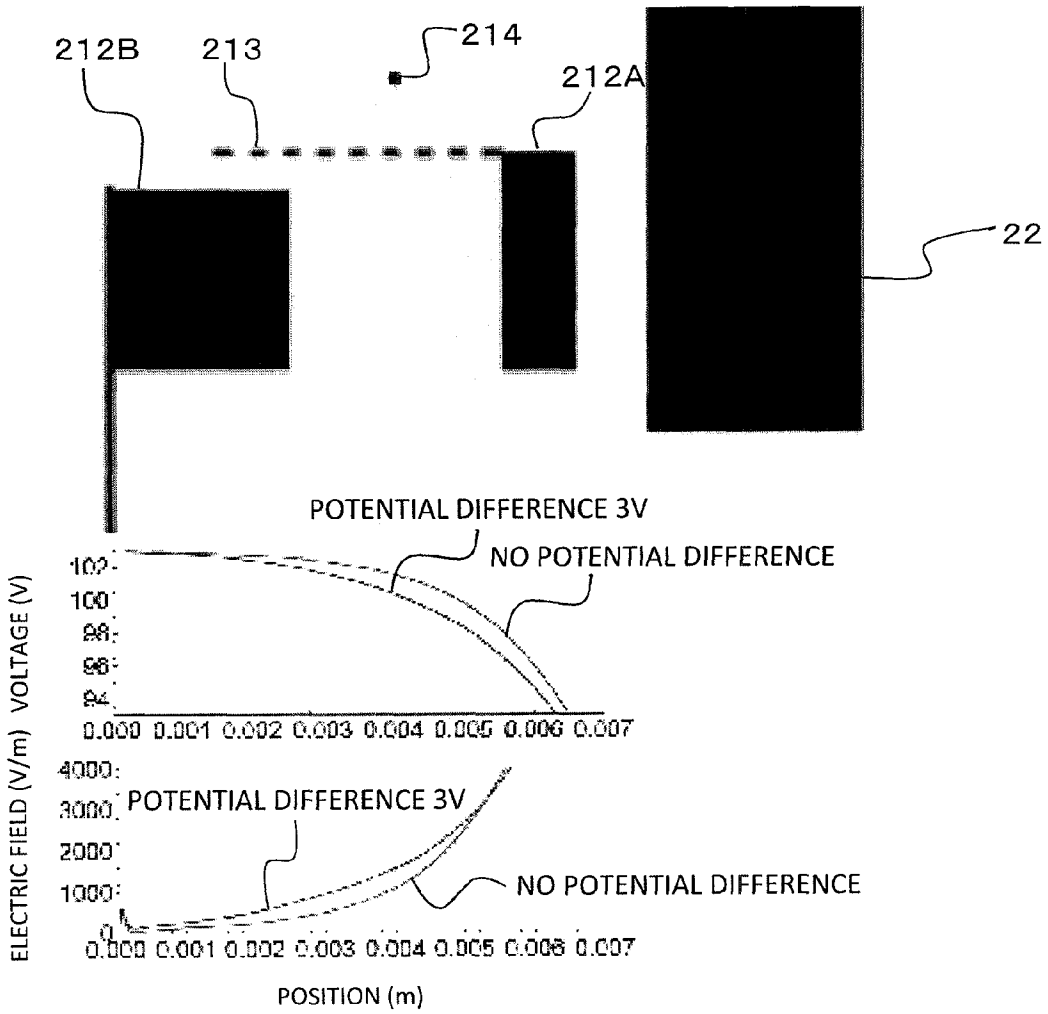
FIG. 7 is a graph representing a potential distribution inside the ionization chamber in the case of providing a potential difference between a first tubular body and a second tubular body in the present embodiment.

Moreover, FIG. 7 shows comparison results of the potential distributions in the ionization chamber 211 between the case of providing no potential difference between the potentials of the first cylindrical body element 212A and the second cylindrical body element 212B and the case of providing a potential difference of 3V. According to the comparison results shown in FIG. 7, it can be seen that a gradient of the electric field can be more generated to a back of the ionization chamber 211 in the case of providing the potential difference of 3V than the case of providing no potential difference. As described above, in the case where the potential gradient can be generated to the back of the ionization chamber 211, the ions can be further efficiently extracted from the back of the ionization chamber 211.

According to the ionization chamber 21 of the present embodiment configured as described above, since the electric field caused by the potential of the thermionic emission filament 214 can be prevented from permeating into the ionization chamber 211, even though the potential of the thermionic emission filament 214 is changed in order to adjust an ionization condition to be suitable for a sample, the electric field in the ionization chamber 211 is not influenced. Therefore, it becomes possible to set the potential of the thermionic emission filament 214 and the potential of the ion extraction electrode 22 can be independently set, and both the ideal thermo-electron supply and the potential gradient in the ionization chamber 211 can be made compatible simultaneously.

Since the opening ratio of the mesh 213 is 50 to 90%, the balance between the transmission efficiency of the thermo-electrons passing through the mesh 213 and the strength of the mesh 213 can be optimized.

Since the mesh 213 is provided separately from the conductive cylindrical body 212, a degree of freedom in designing the ion source 21, and further both the thermo-electron supply and the potential gradient in the ionization chamber 211 can be easily made compatible.

In the case where the ratio between the thickness (l) of the conductive cylindrical body and the width (d) of the penetration portion becomes larger, the thickness (l) of the conductive cylindrical body increases with respect to the width (d) of the penetration portion, and it is liable that the thermo-electron supply to the ionization chamber 211 is reduced.

Further, in the case where the ratio between the thickness (l) of the conductive cylindrical body and the width (d) of the penetration portion becomes smaller, the width (d) of the penetration portion with respect to the thickness (l) of the conductive cylindrical body increases, and it is liable that the penetration of the electric field generated by the potential of the thermionic emission filament 214 into the ionization chamber 211 is increased.

In this regard, in the present embodiment, since the ratio between the thickness (l) of the conductive cylindrical body 212 and the width (d) of the circumferential slit 212S is set to be $0.5<l/d<2$, both the optimal thermo-electron supply to the ionization chamber 211 and the potential gradient in the ionization chamber 211 can be made compatible. The ratio between the thickness (l) of the conductive cylindrical body 212 and the width (d) of the circumferential of 0.7 to 1.5 is more desirable.

The thickness (l) of the conductive cylindrical body 212 is modifiable due to a size of the ionization chamber 21. The thickness (l) may be set to 1 mm to 10 mm.

By increasing the radial distance (x) between the outer surface of the opening of the circumferential slit 212S and the inner surface of the mesh 213 as well as the radial distance (y) between the outer surface of the opening of the circumferential slit 212S and the thermionic emission filament 214, the external electric field can be suppressed from permeating into the ionization chamber 211. However, if the distance (x) is increased too long, it is liable that the control at the time of introducing the thermo-electrons into the ionization chamber 211 becomes difficult. Further, if the distance (y) is increased too long, it is liable that the amount of the thermo electrons to be supplied into the ionization chamber 211 is reduced.

Also, in this regard, according to the ion source 21 of the present embodiment, since the distances (x) and (y) are set to be optimal, the suppression of the external electric field from permeating into the ionization chamber 211 and the suitable supply of the thermo-electrons to the ionization chamber 211 can be optimally balanced.

Since the slit 212S formed to be circular shaped, there is such an effect that the potentials of the first cylindrical body element 212A and the second cylindrical body element 212B can be independently set, and the degree of freedom in designing the ion source 21 can be further improved.

Furthermore, since a potential difference is provided between the first cylindrical body element 212A and the second cylindrical body element 212B, it is possible to produce a gradient of the electric field to the back of the ionization chamber 211 and the ions can be further efficiently extracted.

According to the ion source 21 according to the present embodiment, since the ions can be efficiently extracted from the ionization chamber 211, by using this ion source 21 as the residual gas analyzer RGA for analyzing the residual gas in the vacuum chamber VC, it is possible to detect even low concentration gas remaining in the vacuum chamber VC.

Note that, the present invention should not be limited to the above embodiment.

For example, the conductive tubular body may be any one so long as it is made of a conductive material and is not limited to that formed of a non-porous wall.

The conductive tubular body may be formed of three or more tubular body elements which are separated in the axial direction with their center axes aligned and having two or more circumferential slits formed in these three or more tubular body elements.

The slit may be formed as a partial cut portion in a circle perpendicular to the axial direction in the side wall of the conductive tubular body instead of a circumferential slit.

Figure 8:
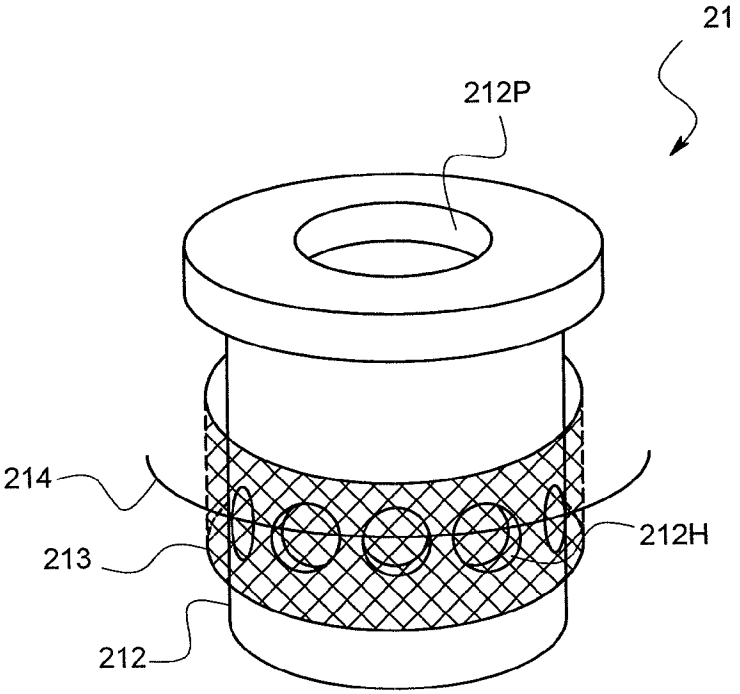
FIGS. 8(*a*) and 8(*b*) are structure views of an ion source according to the other embodiment.
Figure 8:
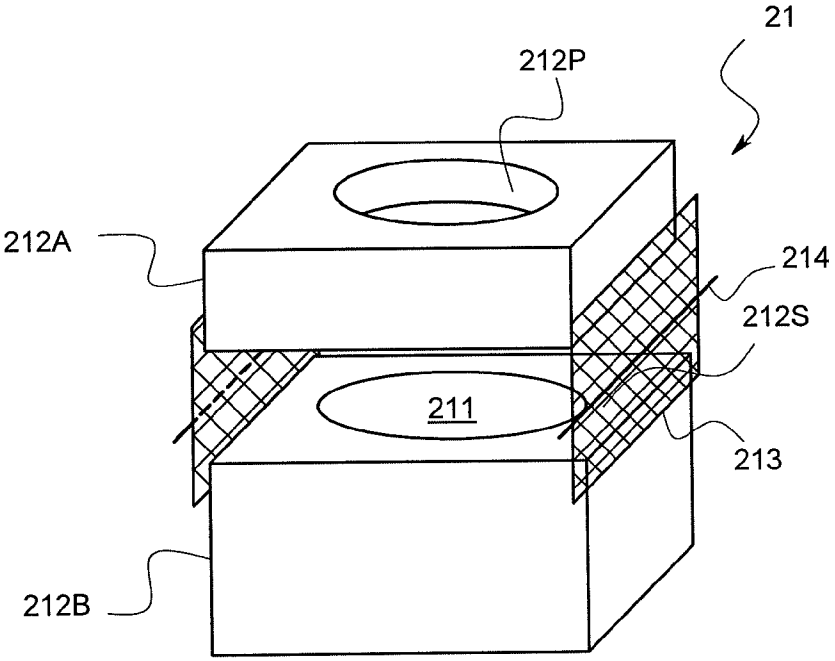

Further, the shape of the conductive tubular body is not limited to be cylindrical and, for example, as shown in FIG. 8(*a*), it may be formed of a rectangular parallelepiped block body or tubular one having a polygonal or irregular cross section in the radial direction where the ionization chamber is formed inside thereof.

Further, the conductive tubular body may not be a rotationally symmetrical one and it may be, for example, a rectangular-like one or the like having a partial portion of the conductive cylindrical body deformed for such as connection with a surrounding member.

Further, the penetration portion formed in the conductive tubular body is not limited to a slit and, as shown in FIG. 8(*b*), a plurality of penetration holes 212H each having an opening of diameter (d) may be formed in the position corresponding to the circumferential slit 212S formed in the conductive tubular body. Further, the shape of each penetration hole 212H is not limited to a circular one, and it may be formed of a polygonal or other irregular one.

The mesh may be arranged so as to cover the entire periphery of the circumferential slit or cover a partial portion of the circumferential slit. Further, so long as the mesh includes a gap for the thermo-electrons to pass through, the shape of the gap is not limited to a vertical lattice pattern, and it may be also possible to have a lateral lattice pattern, oblique lattice pattern, lattice crossing and wired mesh pattern, one or more circular holes or polygonal holes pattern, honeycomb structure pattern or the like.

Although the mesh having an opening ratio of 50 to 90% is optimal for allowing the electrons to efficiently pass through and securing the strength of the mesh, it is needless to say that the mesh having an opening ratio out of this range may be also used.

The mesh may be provided without being separated from the conductive tubular body.

The thermionic emission filament is not limited to that only made of yttria coated iridium but also may be made of rhenium tungsten or the like. Further, the shape thereof is not limited to a semicircular one, and it may be also a ring shaped one, straight line shaped one, coil shaped one, hairpin shaped one or the like. Further, it is not limited to a line shaped one, and it may be also a ribbon shaped one or the like.

The mass spectrometer using this ion source is not limited to a quadrupole mass spectrometer, and it may be other mass spectrometer using an electron ionization method.

Moreover, the mass spectrometer using this ion source may be also used for residual gas analysis in a vacuum chamber which is used for depositing glass or a film, without limiting to a semiconductor.

In addition, various modifications of the present invention can be made without departing from the spirit thereof.

REFERENCE SIGNS LIST

21 . . . Ion source
212P . . . Ion emitting aperture
212S . . . Slit
213 . . . Mesh
214 . . . Thermionic emission filament
212A . . . First cylindrical body element
212B . . . Second cylindrical body element
RGA . . . Residual gas analyzer
VC . . . Vacuum chamber

The invention claimed is:

1. An ion source comprising:

a conductive tubular body having an ion emitting aperture in a tip surface thereof and a penetration portion in a side wall allowing thermo-electrons to pass through from an outside toward an inside;

a mesh surrounding an outer periphery of the penetration portion; and a thermionic emission filament surrounding an outer periphery of the mesh, wherein the ion source is configured such that the thermo-electrons emitted from the thermionic emission filament pass through the mesh and reach the inside of the conductive tubular body through the penetration portion.

2. The ion source according to claim 1, wherein assuming that a thickness of the conductive tubular body is 1 and a width of the penetration portion is d, the relationship between 1 and d is represented by $0.5<l/d<2$.

3. The ion source according to claim 1, wherein the mesh is provided separately from the conductive tubular body so as to cover an entire part or a partial portion of an outside of the penetration portion.

4. The ion source according to claim 1, wherein the conductive tubular body comprises two tubular body elements separated in an axial direction with their central axes aligned and a circumferential slit is formed between these two tubular body elements.

5. The ion source according to claim 1, wherein a potential difference is provided between the two tubular body elements.

6. A quadrupole mass spectrometer comprising the ion source according to claim 1.

7. A residual gas analyzing method comprising analyzing residual gas in a vacuum chamber using the quadrupole mass spectrometer according to claim 6.

* * * * *